US005931364A

United States Patent [19]

Dennis

[11] Patent Number: 5,931,364

[45] Date of Patent: Aug. 3, 1999

[54] FASTENING TOOL FOR SECURING AN OBJECT TO A SUBSTRATE

[75] Inventor: Donald Dennis, Manchester, N.H.

[73] Assignee: Acme Staple Company, Inc., West Franklin, N.H.

[21] Appl. No.: 08/882,314

[22] Filed: Jun. 25, 1997

[51] Int. Cl.[6] ..... B25C 5/02

[52] U.S. Cl. ..... 227/109; 227/120; 227/132

[58] Field of Search ..... 227/107, 109, 227/119, 120, 132, 134, 156

[56] References Cited

U.S. PATENT DOCUMENTS

| | | | |
|---|---|---|---|
| 1,927,274 | 9/1933 | Baur . | |
| 2,716,749 | 9/1955 | Timmerbeil . | |
| 2,719,294 | 10/1955 | Marano | 227/132 |
| 2,754,515 | 7/1956 | King . | |
| 2,917,747 | 12/1959 | Marano . | |
| 2,923,938 | 2/1960 | Rinehardt . | |
| 3,510,043 | 5/1970 | Larson . | |
| 3,586,231 | 6/1971 | Wilson . | |
| 3,753,524 | 8/1973 | Heyward . | |
| 3,762,620 | 10/1973 | Geist . | |
| 3,809,307 | 5/1974 | Wandel et al. . | |
| 3,855,688 | 12/1974 | Knohl . | |
| 3,942,700 | 3/1976 | Maier . | |
| 3,948,426 | 4/1976 | La Pointe . | |
| 3,958,738 | 5/1976 | Tremblay . | |
| 4,087,035 | 5/1978 | Harmon . | |
| 4,184,620 | 1/1980 | Ewig . | |
| 4,211,353 | 7/1980 | Aunis . | |
| 4,225,075 | 9/1980 | Chi . | |
| 4,424,929 | 1/1984 | Weis | 227/120 |
| 4,552,296 | 11/1985 | Sheng . | |
| 4,556,161 | 12/1985 | Oide | 227/109 |
| 4,667,865 | 5/1987 | Judge . | |
| 4,801,061 | 1/1989 | Mangone, Jr. . | |
| 4,805,824 | 2/1989 | Erickson . | |
| 5,335,839 | 8/1994 | Fealey . | |
| 5,350,267 | 9/1994 | Mangone, Jr. . | |
| 5,718,548 | 2/1998 | Cotellessa | 227/156 |
| 5,735,444 | 4/1998 | Wingert | 227/120 |

OTHER PUBLICATIONS

Makita Staple Gun Model TS713 Operating Instructions in Japanese together with an English Translation thereof, 1987.

*Primary Examiner*—Stephen F. Gerrity
*Attorney, Agent, or Firm*—Nield, Lemack & Dingman

[57] ABSTRACT

A fastening tool having an alignment device that prevents the tool from firing unless the tool is properly aligned with respect to the object to be fastened. The tool includes a housing and a driver mounted in the housing and moveable with respect to the housing, the driver having a driving surface for engaging a fastener such as a staple. A magazine assembly and nosepiece are associated with the housing for positioning and aligning the fastener in the path of the driver so that when actuated, the driver strikes the fastener and forcibly ejects it from the magazine into the substrate on which the object to be fastened is to be secured. The magazine can be removably secured to the housing. A nose piece assembly having a semi-circular bottom cut-out is secured to the housing and includes structure for ensuring that the object to be fastened is properly aligned in the cut-out before the driver can be actuated. In another embodiment of the present invention, the fastening tool is designed to optionally automatically cause a second object, such as insulated material, a washer, or a gasket, to be simultaneously driven from the magazine with the fastener and secured thereby on the substrate, thereby insulating the fastener, for example, from the item being fastened.

18 Claims, 12 Drawing Sheets

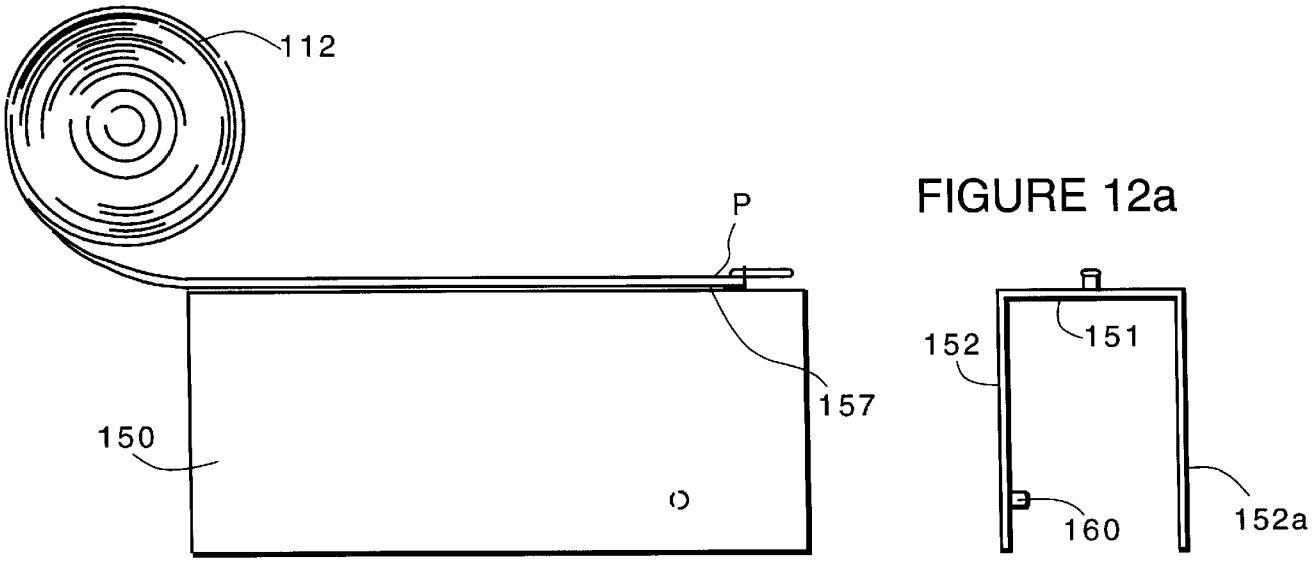
FIGURE 12
FIGURE 12a
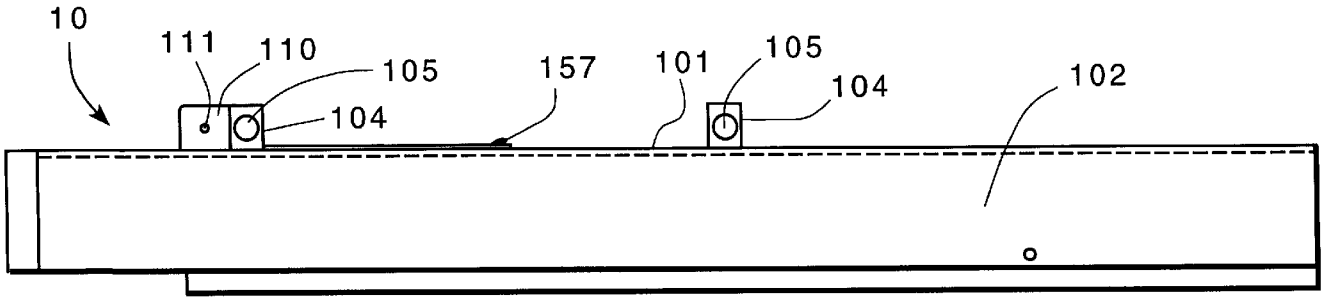
FIGURE 11

FASTENING TOOL FOR SECURING AN OBJECT TO A SUBSTRATE

BACKGROUND OF THE INVENTION

The present invention is directed towards a staple gun or fastener driving or applying tool for driving staples, fasteners, insulators, and the like into surfaces.

Staple, nail, brad, screw and other fastener-driving applying tools for industrial and commercial use and for use by homeowners are well known. Often such tools are used to secure cables, wires, tubing and the like to a substrate such as wood by driving the fastener into the substrate, the fastener thereby surrounding the cable, wire or tubing. If, however, the fastener tool is not properly aligned with respect to the cable, wire or tubing, the fastener being applied may penetrate the sheathing on the cable, wire or tubing, and the electrical current being carried may be deleteriously altered, resulting in a short circuit, or the tubing may leak. Moreover, even if a short or leak does not result, the element being fastened may not be properly secured to the substrate by a misaligned fastener such as a staple.

In addition, it is often desirable to staple electrical cable, wire or tubing with insulated staples to prevent chafing of the wire, cable or tubing. However, no viable stapling or nailing apparatus has been developed to date to effectively accomplish this goal repeatably and automatically with the speed and ease typically associated with a staple, nail or other fastener applying tool or gun. Similarly, it would be desirable to have a fastener tool such as a staple gun that can accommodate various size fasteners without requiring auxiliary equipment.

It is therefore an object of the present invention to provide an improved fastener driving tool or gun which ensures proper alignment of the tool and/or the fasteners over the object being fastened.

It is a further object of the present invention to provide an improved fastener driving tool or gun that can accommodate various sized and configured fasteners, and optionally can accommodate a second element that once driven from the tool, becomes partially or fully interposed between the fastener and the object being fastened.

It is a still further object of the present invention to provide a staple gun that automatically and repeatably drives staples with or without insulation for the staples into a substrate to secure an object therein.

SUMMARY OF THE INVENTION

The problems of the prior art have been overcome by the present invention, which provides a fastening tool having an alignment device that prevents the tool from firing unless the tool is properly aligned with respect to the object to be fastened. Thus, the tool includes a housing and a driver reciprocally mounted in the housing and moveable with respect to the housing, the driver having a driving surface for engaging a fastener such as a staple. A magazine assembly is associated with the housing for positioning and aligning the fastener in the path of the driver so that when actuated, the driver strikes the fastener and forcibly ejects it from the magazine into the substrate on which the object to be fastened is to be secured. The magazine can be removably secured to the housing. A nose piece assembly having a semi-circular bottom cut-out is secured to the housing and includes means for ensuring that the object to be fastened is properly aligned in the cut-out before the driver can be actuated. Suitable fasteners include staples (of various sizes and configurations), nails, brads, rivets, etc.

In another embodiment of the present invention, the fastening tool is also designed to optionally automatically cause a second object, such as insulating material, a washer, or a gasket, to be simultaneously driven from the magazine with the fastener and secured thereby on the substrate, thereby insulating the fastener, for example, from the item being fastened.

BRIEF DESCRIPTION OF THE DRAWINGS

FIG. 11 is a side view of the staple magazine in accordance with the present invention;

FIG. 12 is a side view of the staple pusher in accordance with the present invention;

FIG. 12*a* is a rear view of the staple pusher in accordance with the present invention;

DETAILED DESCRIPTION OF THE INVENTION

Figure 1:
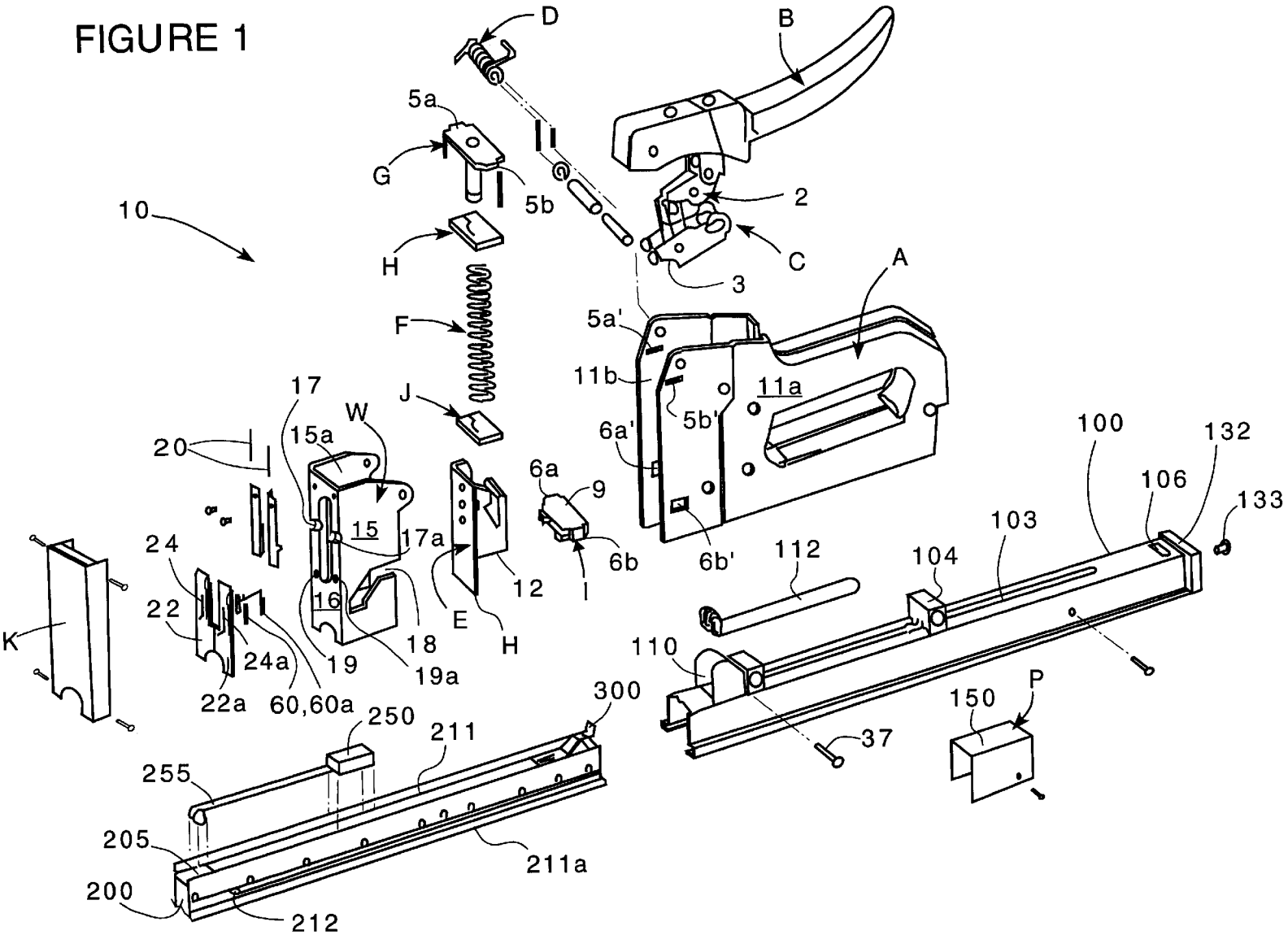
FIG. 1 is an exploded view of a staple gun in accordance with the present invention.

Turning first to FIG. 1, there is shown at 10 a preferred embodiment of the present invention, which is a spring actuated staple gun adapted to drive U-shaped staples housed in a magazine into a surface. The gun 10 includes a tool body A comprised of two stamped nickel-plated sheet metal sides 11*a* and 11*b* that form a housing therebetween. Alternatively, the housing could be a molded body. Pivotally fixed to the underside of a handle B is a spring-loaded lever assembly C, substantially located in said housing, which includes extended link 2 and lifter 3 and allows the handle of the gun to be cocked and uncocked in order to actuate the gun. A handle return spring D is fixed to the handle B. Spring retainer G has opposite flanges 5*a,* 5*b* that align with opposite slots 5*a*' 5*b*' in sides 11*a* and 11*b* of the tool body A to fix spring retainer G therein. Top spring pad H cushions driver spring F against the spring retainer G. A driver spring pad J aligns with the bottom of driver spring F and sits in the body of driver E. Bottom stop plate I (and optional bottom stop pad 9) has opposite flanges 6*a,* 6*b* that align with opposite slots 6*a*', 6*b*' in sides 11*a* and 11*b* of the tool body A to fix the same in the housing, and thereby limit the downward movement of driver E by preventing the seat 12 of driver E from extending past the surface of the stop plate I. Compression of the handle B first causes a pair of opposite lips L, L' of lifter 3, which lips engage the driver E, to lift the driver upward against the bias of driver spring F. Further compression of the handle 3 causes the lips L, L' to release from the driver, thereby causing the driver spring F to force the driver downward. The downward force imparted to the driver E by the spring F causes the head H of the driver E to strike a staple located in the staple rail in the path of the driver E, and drive the same into the work surface below. Those skilled in the art will recognize that the foregoing design is substantially conventional in the art, and other ways to actuate the driver including leaf springs, torsion springs, electric and compressed gas (e.g. air) can be used.

Figure 2:
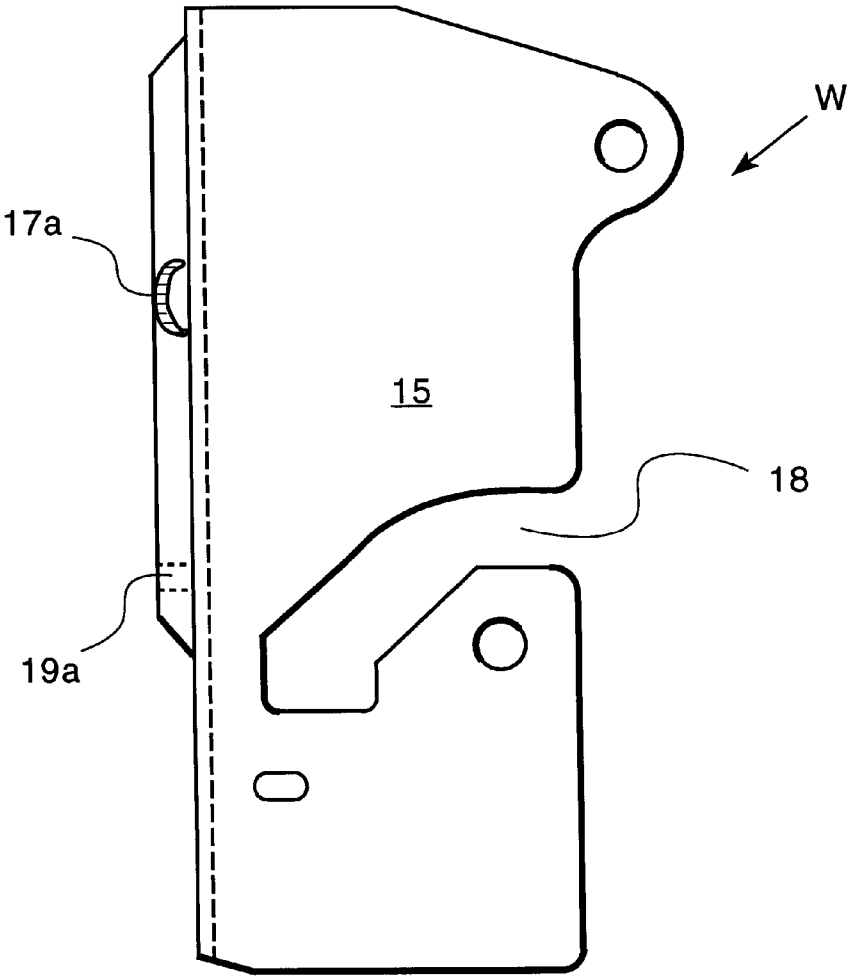
FIG. 2 is a side view of a nose piece in accordance with the present invention.
Figure 3:
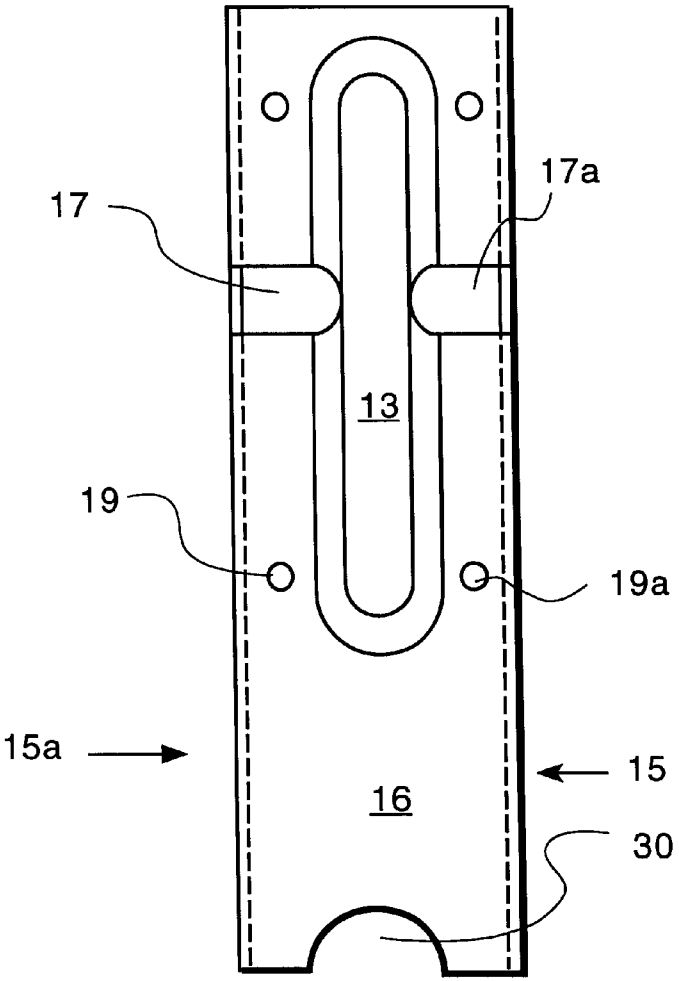
FIG. 3 is a front view of a nose piece in accordance with the present invention.

In order to ensure that the fastening tool is properly positioned over the item to be fastened before firing, an alignment assembly is provided and will now be described with reference to FIGS. 1–6. FIGS. 2 and 3 best illustrate a C-shaped nose piece W. The nose piece W has opposite sides 15, 15*a* joined by a front face 16. Each opposite side 15, 15*a* includes a channel 18 (FIG. 18) to accommodates the flanges 6*a,* 6*b* of bottom stop plate I when the nose piece W is positioned on the tool body A. The face 16 of the nose piece W includes along each side edge of the face 16 a track. In the embodiment shown, the face 16 is formed with a central ridge 13 (FIGS. 3, 3A), which defines between each side edge of face 16 each track. The ridge 13 is optional, depending upon the specific driver design. A pair of slots 17, 17*a* are located just above the driver blade rest position, and extend from an edge of the face 16 towards the center of the face 16 and terminate on the ridge 13. Positioned on face 16 below the slots 17, 17*a* are a pair of spring stop pins 19, 19*a*. The spring stops 19, 19*a* can be secured to the face surface by any suitable means known to those skilled in the art, such as by welding or brazing. Alternatively, apertures can be formed in the face 16, and pins having a slightly larger diameter than the apertures can be forcibly inserted in to the apertures to form the spring stops. The lower end of the nose piece W is formed with a suitable cut-out 30 the contour of which is designed to receive the item being fastened. A correspondingly dimensioned cut-out is formed in the cap K for similar reasons.

Figure 2A:
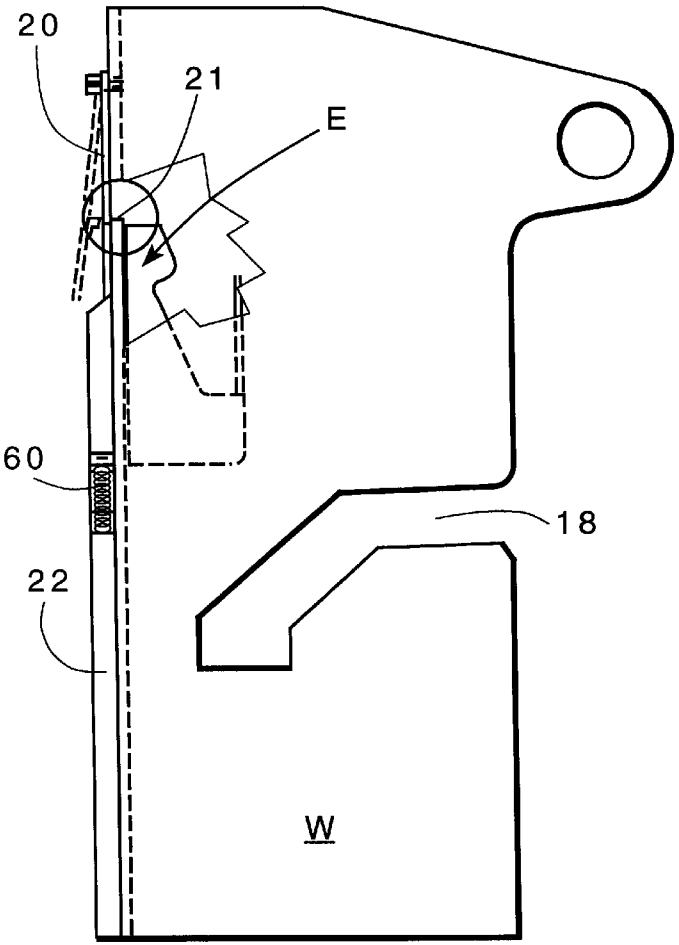
FIG. 2A is a side view of the nose piece of FIG. 2 in greater detail in accordance with the present invention.
Figure 3A:
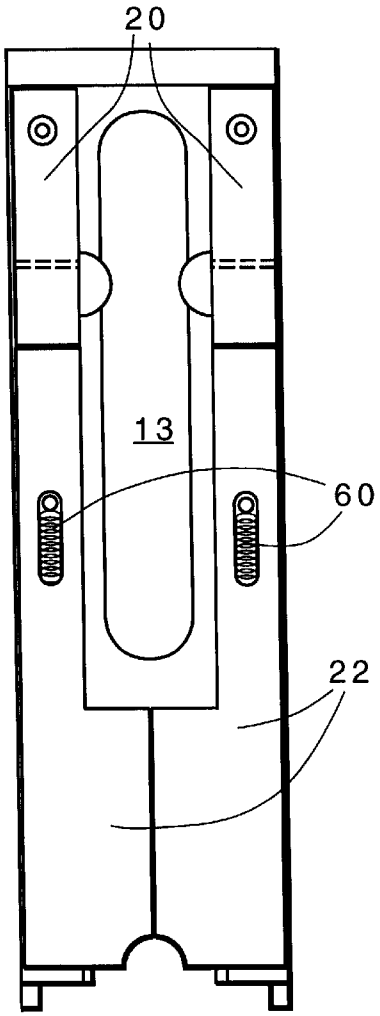
FIG. 3A is a front view of the nose piece of FIG. 3 in greater detail in accordance with the present invention.
Figure 5:
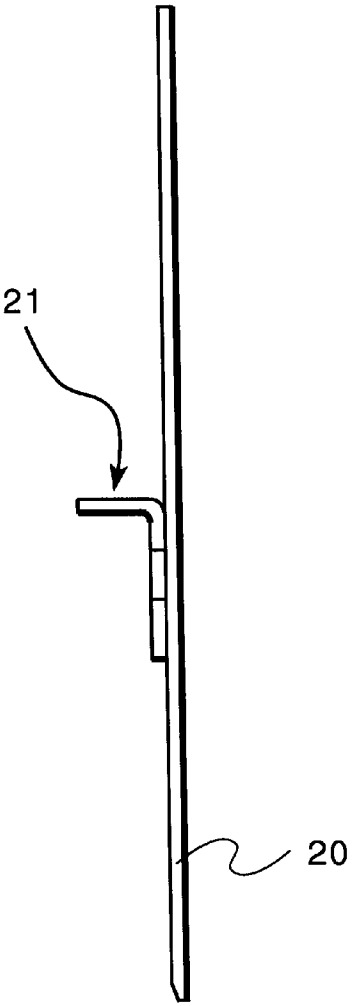
FIG. 5 is a side view of the nose piece spring leaf in accordance with the present invention.
Figure 4:
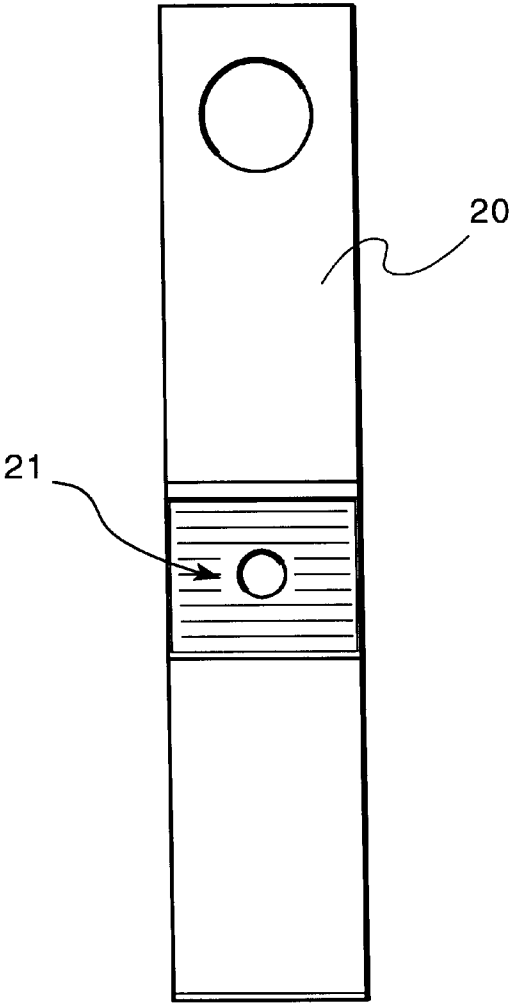
FIG. 4 is a rear view of the nose piece leaf spring in accordance with the present invention.
Figure 6:
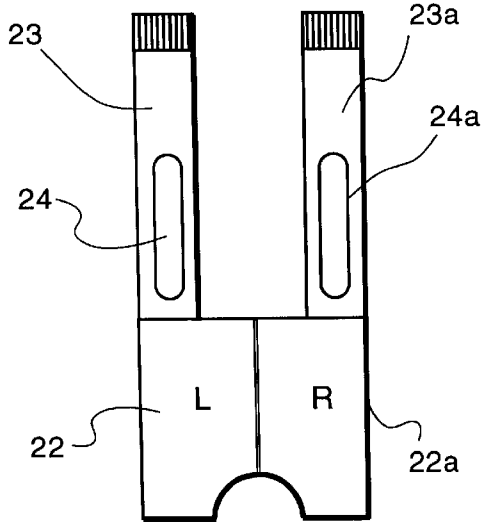
FIG. 6 is a front view of the lock out push rods in accordance with the present invention.

Steel leaf spring 20 is shown in FIGS. 4 and 5 as a flat metal rectangular piece having a lock tab 21 affixed to the underside of the spring 20 such as by brazing. Preferably at least two such leaf springs 20 are used, each being dimensioned so as to sit in each track formed by the nose piece W and cap K. A single layer leaf spring 0.25 inches wide by 1.3 inches long by 0.011 inches thick has been found to be suitable. Thus, a pair of leaf springs are secured towards the top of the face 16 within the track formed by ridge 13 and extend downwardly past the slots 17, 17*a* so as to substantially cover the same, as can be best seen in FIGS. 2A and 3A. The lower free end of each leaf spring is positioned upon the wedge shaped or tapered portions of each push rod 22 and 22*a* (FIG. 6). The location of each lock tab 21 on each leaf spring 20 is such that when the spring 20 is secured on the nose piece W, each lock tab 21 fits in a respective slot 17, 17*a,* and projects through the slot past the rear surface of the front face 16 of the nose piece W (FIG. 2A). The lock tabs 21 project far enough through the respective slots 17, 17*a* so as to be (removably) positioned in the path of the drive blade E of the fastening tool.

Figure 7:
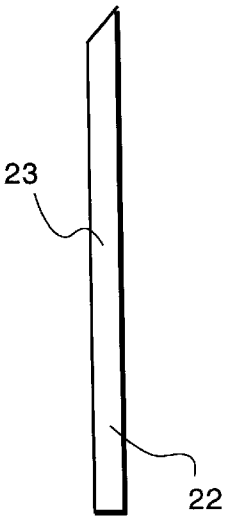
FIG. 7 is a side view of a lock out push rod of FIG. 6.

FIGS. 6 and 7 illustrate the dual system lock out push rods 22, 22*a* that form part of the alignment assembly. The push rods are L-shaped with the upper column portion 23, 23*a* suitably dimensioned to sit on the face 16 of nose piece W, such as in the track formed by face 16 of nose piece W and cap K (FIG. 3A). The minimum thickness of the push rods 22, 22*a* should be sufficient to enable the leaf spring with locktab 21 to move far enough forward to no longer obstruct the upward motion of the driver when actuated. Formed in each column portion 23, 23*a* are respective slots 24, 24*a*. The top end of each column 23, 23*a* is beveled at preferably about a 40° angle, the bevel extending about 0.15 inches, as best seen in FIG. 7. The aforementioned bevel specifications work well for 14-2, 14-3, 12-2, 12-3 and 10-2 building wire. For larger diameter cable, tubing or the like, a longer bevel is preferred.

In the assembled condition, the push rods 22, 22*a* are located on the face 16 of nose W such that the spring stops 19, 19*a* are located at the top of slots 24, 24*a*. Compression springs 60, 60*a* (FIG. 3A) are then inserted in each spring slot 24, 24*a* and are biased at one end against the spring stops 19, 19*a* and at the opposite end against the bottom of slot 24, 24*a*. The beveled end of each column 23, 23*a* of the push rods 22, 22*a* slides just under each free end of leaf springs 20 and 20*a,* as shown in phantom lines in FIG. 3A. The opposite lower end of each push rod 22, 22*a* extends over cut-out 30 in the nose piece W. As a result, when the item to be fastened is located and properly aligned in the cut-out 30, both push rods 22, 22*a* are independently biased upwardly against the force of the compression springs 60, 60*a* positioned in slots 24, 24*a*. The beveled end of each column 23, 23*a* thus slides upwardly and under the respective free ends of the leaf springs 20 and 20*a,* thereby lifting the leaf springs away from the front face 16 of the nose piece W in the direction of arrow A in FIG. 2A. As the leaf springs 20 and 20*a* are so lifted, the lock tabs 21 are raised out of the respective slots 17, 17*a,* and are thereby withdrawn from the path of the driver E, allowing the driver E to be actuated (i.e., lifted and then released).

In the event that the item to be fastened is not properly aligned in cut-out 30, and no push rods or only one push rod 22 is lifted upwardly, thereby releasing no lock tabs 21 or only one lock tab 21, the driver E will be prevented from being actuated and the tool will not fire. Other equivalent alignment means will also be apparent to those skilled in the art. For example, the alignment means could be designed so that the object to be fastened is not directly below the drive path.

Figure 8:
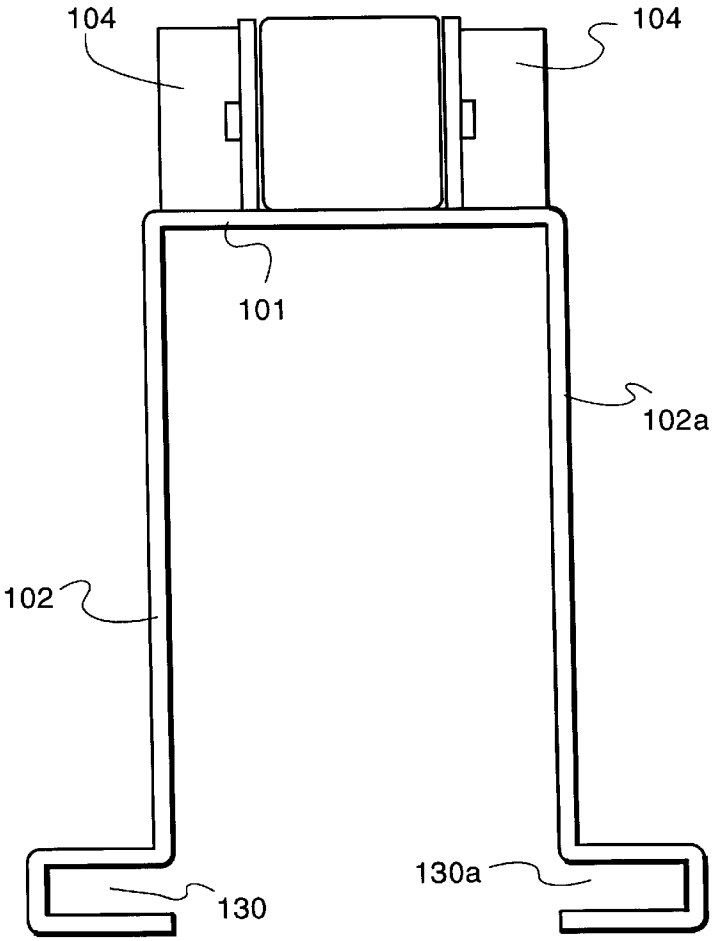
FIG. 8 is a front profile of the staple magazine in accordance with the present invention.
Figure 9:
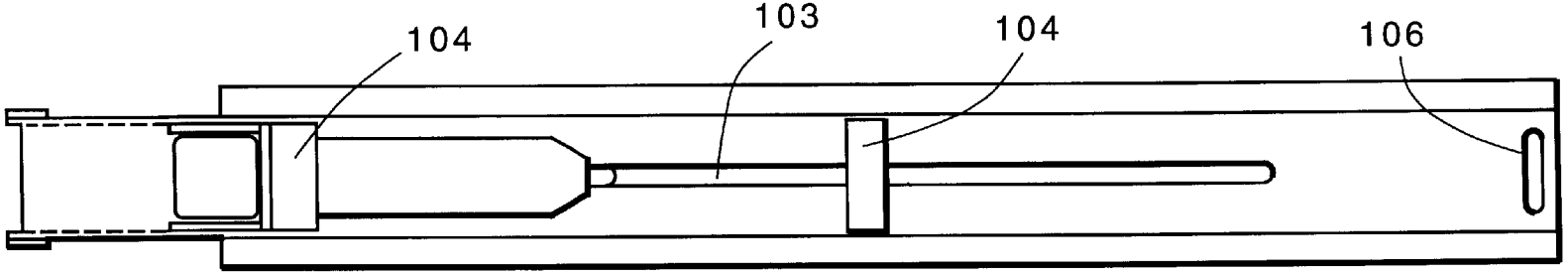
FIG. 9 is a top view of the staple magazine in accordance with the present invention.
Figure 10:
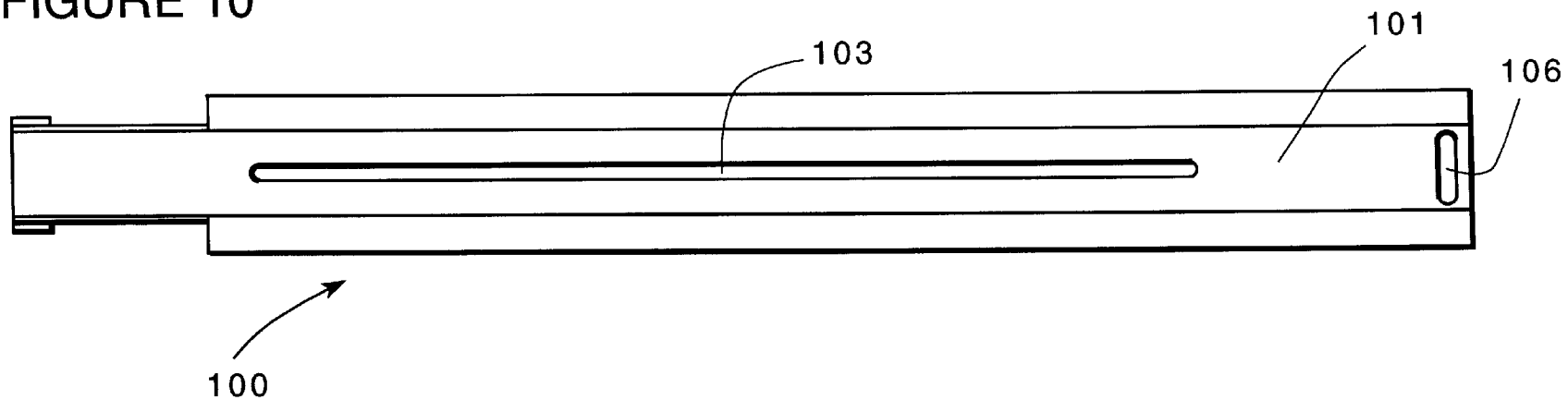
FIG. 10 is a bottom view of the staple magazine in accordance with the present invention.
Figure 13:
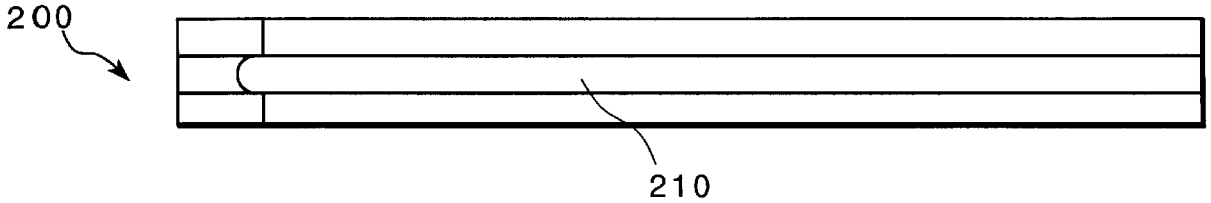
FIG. 13 is a bottom view of the staple rail in accordance with the present invention.
Figure 14:
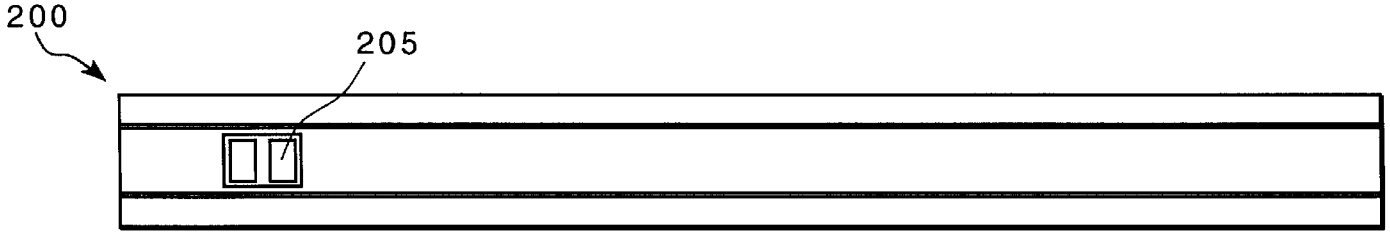
FIG. 14 is a top view of the staple rail in accordance with the present invention.
Figure 15:
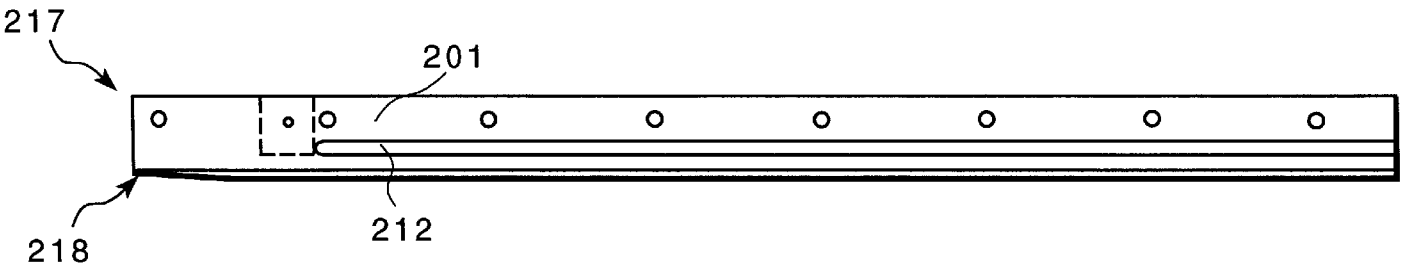
FIG. 15 is a side view of the staple rail in accordance with the present invention.
Figure 20:
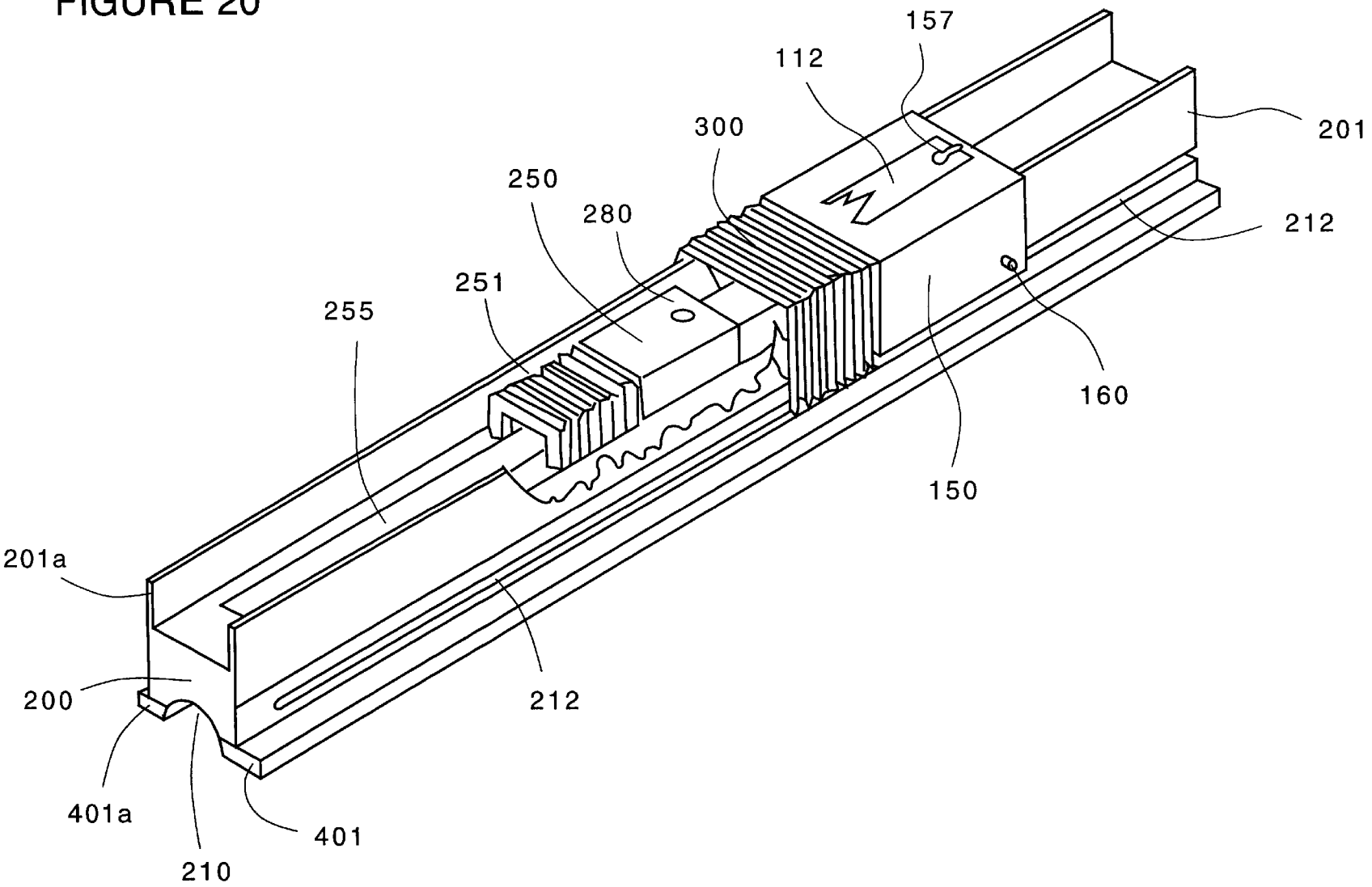
FIG. 20 is an isometric view of the staple rail in accordance with the present invention.

With reference to FIGS. 8–11 and 20, a magazine assembly will now be described in connection with the preferred embodiment of a staple gun, although those skilled in the art will appreciate that the magazine assembly could be used with other fastening tools as well. The staple magazine 100 is located along the underside of the staple gun, and is a substantially U-shaped housing, as best seen in FIG. 8, with the bottom end being open. The staple magazine 100 is defined by a top 101 and opposite descending side walls 102, 102*a* extending from the top 101 at substantially right angles thereto. Each side wall 102, 102*a* terminates in an outwardly projecting C-shaped portion as shown, to form opposite tracks 130, 130*a*. A plurality of mounting blocks 104, preferably two, having pin holes 105 are affixed to the top 101 of the magazine 100 in order to detachably mount the magazine 100 to the staple gun housing through complementary holes therein. The magazine 100 houses a staple rail 200. As best seen in FIG. 9 and 10, a slot 106 is formed in top 101 and receives a tab of locking mechanism 300 to lock the rail 200 in the magazine. The top 101 of the magazine 100 has a slot 103 centrally located between the side walls 102, 102*a* running substantially the length of the magazine. Attached to top 101 are retainer plates 110, 110*a* (FIG. 11, only 110 shown) having axially aligned pin holes 111 for housing a pin 37 (not shown). A constant force spring 112 is attached at one end to the pin 37 and is coiled around the pin between the retainer plates 110, 110*a*. The constant force spring 112 is positioned on top of the magazine, and its end opposite the end attached to the pin 37 is attached to the top of staple pusher 150 (FIGS. 8, 12 and 12*a*) at point P such as by a hook 157 protruding through slot 103, thus creating a space between the top of pusher 150 and spring 112. The spring 112 biases the staple pusher 150 toward the nose end 217 of the magazine, urging one or more staples 300 in the same direction, the forwardmost staple being axially aligned in the path of the driver E. The staple pusher 150 is substantially U-shaped, having a top flat surface 151 and opposite side rails 152, 152*a*. A forward stop 160 can be appropriately located on the staple pusher 150 (FIG. 20). The pusher 150 is dimensioned so as to slide within staple magazine 100, particularly under top 101 and between sides 102 and 102*a* of staple magazine 100. The pusher 150 is similarly dimensioned to ride over staple rail 200, which will now be discussed in greater detail with reference to FIGS. 13–16 and 20. Other means for urging fasteners towards the front of the tool will be apparent to those skilled in the art, including other forms of springs, including compression springs, other means of urging, such as cables, rachet mechanisms, gravity, etc.

Figure 16:
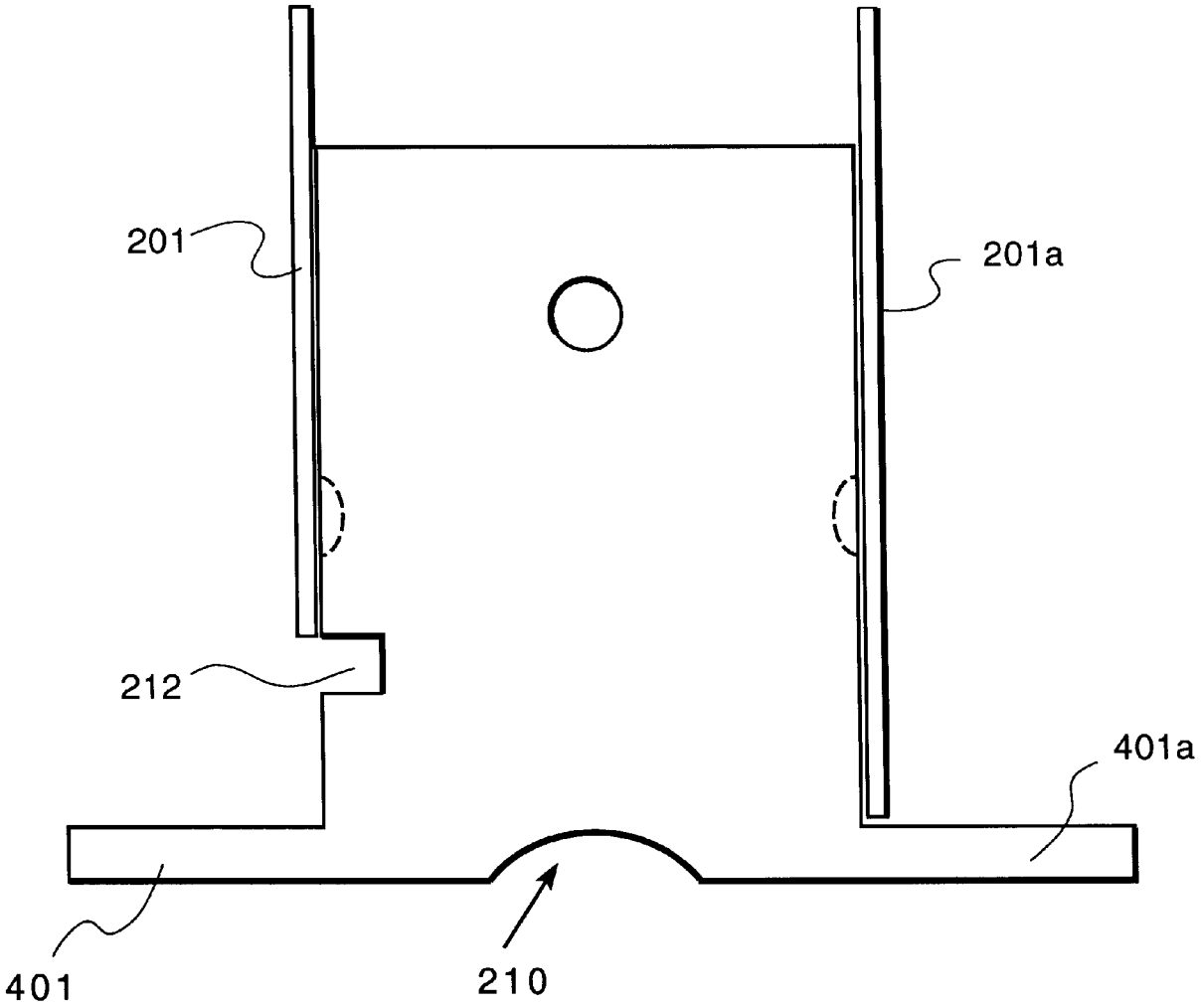
FIG. 16 is a rear view of the staple rail in accordance with the present invention.

The staple rail 200 is designed and dimensioned to slide inside the staple magazine housing 100. As best seen in FIGS. 16 and 20, the staple rail 200 has opposite horizontal feet 401, 401*a* that slide in tracks 130, 130*a* formed by the C-shaped portions of the staple magazine 100 (FIG. 8). The bottom surface of the rail 200 has a central groove 210 along its length to accommodate the material to be stapled. The nose end 217 of the rail 200 has its bottom tapered at 218 (FIG. 15) so that the staple gun can be rocked forward (and the alignment mechanism can be actuated) when fastening or stapling smaller objects. A taper of about 20° has been found to be suitable. A spring cavity or aperture 205 (FIG. 14) is formed in the top of the staple rail 200 to accommodate a further constant force spring associated with an insulator pusher, as described in greater detail below. Side rails 201, 201*a* (FIGS. 15, 16 and 20) are affixed to the sides of the staple rail 200, such as by riveting or spot welding, and extend above the top of the rail 200 to create a track 240 between the side rails in which the insulator pusher 250 and the insulators 251 ride. The outsides of the side rails form a track for the staple(s) 300 and staple pusher 150 (FIG. 20). Side rails 0.020 inches thick and made of stainless steel have been found to be suitable. At least one of the side rails (in the embodiment shown, side rail 201) does not extend down to the foot 201 of the rail 200, in order to expose a small grooved slot or track 212 along a portion of the length of that side of the staple rail 200. A button 160 (FIGS. 12*a*, 20) on the inside surface of side 152 of the staple pusher 150 rides in this grooved track 212. This stabilizes the staple pusher 150, especially when there are few staples 300 in the magazine. It also effectively serves as a forward stop as the track 212 terminates. Tail block 132 is secured to the magazine such as by screw 133 (FIG. 1).

Figure 17:
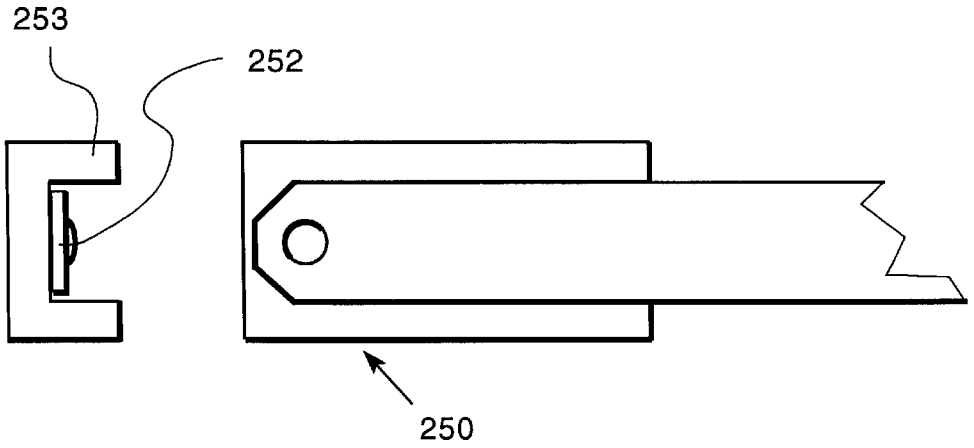
FIG. 17 is an end and bottom view of the insulator pusher in accordance with the present invention.
Figure 18:
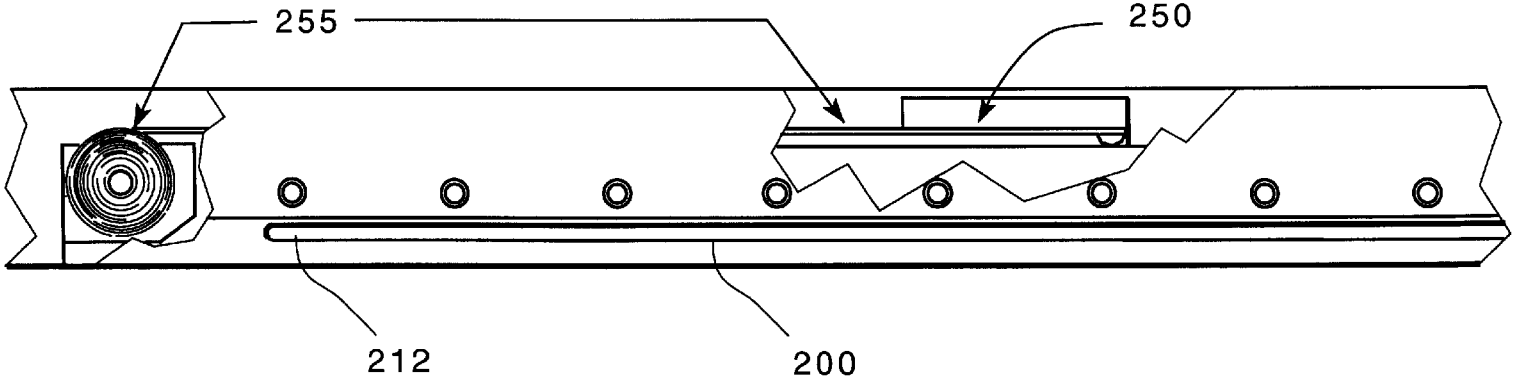
FIG. 18 is a side view of the insulator pusher and constant force spring shown in the staple rail in accordance with the present invention.

FIG. 17 shows an end view of insulator pusher 250. The insulator pusher 250 is substantially U-shaped, and is dimensioned to ride in the track 240 formed between side rails 201, 201*a* of the staple rail 200, and under the top 151 of staple pusher 150 and under any staples in the magazine (FIG. 20). Preferably the insulators are positioned with respect to the fasterners such that the entire dimension of each insulator is located substantially immediately underneath the corresponding fastener but does not extend below the lowest portion of the fastener. In the embodiment where the fasteners are staples, the insulator is preferably located such that the uppermost portion of the insulators are at least horizontally aligned with, and are preferably above, the lowermost vertical portion (leg) of the staples. In this way, the required drive stroke to drive the staple and insulator from the magazine is minimized. A pre-cocking device is not necessary. Attached to the underside 252 of insulator pusher 250 by any suitable means is one end of a constant force spring 255. Those skilled in the art will appreciate that other types of springs could be used. In the embodiment shown, the spring 255 is attached to the underside 252 of the insulator pusher 250 by a fastening pin or rivet 280 (FIG. 20) seated in hole 253. The constant force spring 255 extends from the pusher 250 down into aperture 205 in the staple rail 200, where it is coiled on a pin fixed to the sides of the staple rail 200 (FIG. 18). The spring 255 biases the insulator pusher 250 toward the nose end 217 of the magazine, urging one or more insulators 251 in the same direction, the forwardmost insulator being axially aligned under the forwardmost staple and in the path of the driver E. The location of the aperture 205 and the dimensions of the insulator pusher are such that with no insulators in the magazine, the insulator pusher does not extend into the path of the driver E.

Figure 19A:
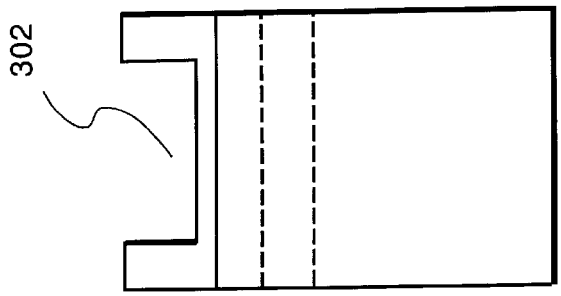
FIG. 19*a* is a side view of the insulator of FIG. 19 in accordance with the present invention.
Figure 19:
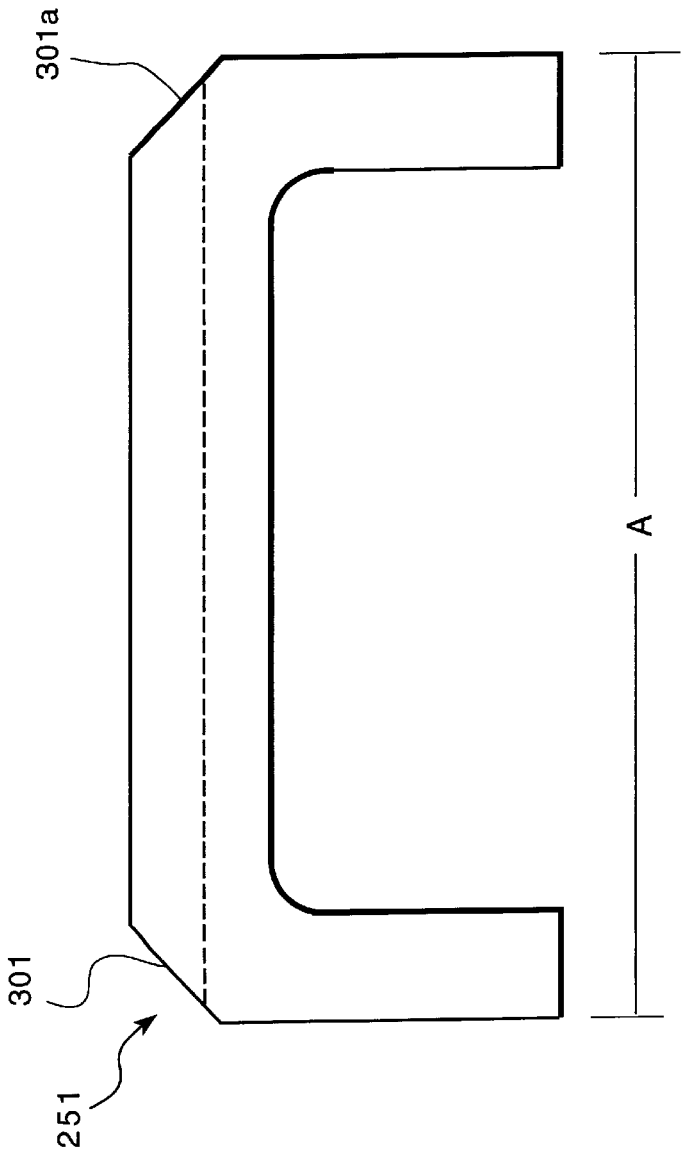
FIG. 19 is a front view of a staple insulator in accordance with the present invention.

The staple gun of the preferred embodiment of the present invention is adapted to drive U-shaped staples that are releasably interconnected in the staple magazine into a substrate in order to secure an object such as wire, cable or tubing in the substrate. In addition, the staple gun of the preferred embodiment of the present invention is adapted to drive insulation for the staples, also releasably interconnected in the staple magazine, but not dependent of and not assembled to the staples. Notwithstanding their disassembled state, both the fastener and the insulator are driven out of the tool during the same drive stroke. Any suitable material can be used for the insulators, such as fish paper or a plastic. The insulators for the staples are axially aligned with the staples so that they become secured under the staples once fired. FIGS. 19 and 19*a* show a staple insulator 251 in accordance with the preferred embodiment of the present invention. The insulator 251 is substantially U-shaped, similar to a conventional staple. The width "A" of the insulator is slightly smaller than the corresponding width of the staple to be insulated, so that the insulator 251 fits underneath the staple as shown in FIG. 20. To that end, the top corners 301, 301*a* of the insulator 251 are rounded or beveled as shown, so that the legs of the staple can easily be driven over the insulator 251. Similarly, the top surface of the insulator 251 includes a groove 302 (FIG. 19*a*), dimensioned to accommodate the top of the staple so that the staple can become interlocked with the insulator 251. Accordingly, after the staple 300 and insulator 251 are driven into a substrate, the staple 300 sits in the groove 302, locking the insulator 251 in place and locking the object to be stapled to the substrate.

Those skilled in the art will recognize that any suitable means can be used to actuate the driver E of the fastening tool, including mechanical means, compressed air, electric means, hydraulics, etc.

In operation, the fastening tool of the preferred embodiment of the present invention is used as follows. First articles such as fasteners (e.g., staples) are loaded into the magazine preferably in side-by-side relation. The tool is then aligned over the object to be fastened and pushed down, thereby causing the dual system push rods to independently retract vertically, thereby elevating the leaf springs away from the front face of the nose piece, and thereby withdrawing the locktaps from the path of the driver. Upon actuation of the driver, fasteners are expelled from the magazine, one at a time, around the object to be fastened and into the substrate. In the embodiment where a second article such as insulators are loaded into the magazine, also preferably in side-by-side relation, the driver simultaneously expels the second article from the housing with the first article, but beneath the the first article. The staple pusher and insulator pusher in the magazine assembly automatically respectively urge the next first article (e.g., staple) and second article (e.g., insulator) into axial alignment with the drive path to be expelled by the next complete drive stroke.

What is claimed is:

1. A fastening tool for securing an object to a substrate, said tool comprising:

a housing;

a driver mounted in said housing for reciprocal movement in a drive path;

actuating means for actuating said driver;

a magazine assembly associated with said housing, said magazine assembly containing a plurality of a first article for securing said object to said substrate, including a forwardmost first article, said first article having a lowermost surface, and containing a plurality of a second article including a forwardmost second article, said second article having an uppermost surface, said magazine assembly having a nose end and a tail end spaced from said nose end;

first means in said magazine assembly for urging said plurality of a first article towards said nose end such that said forwardmost first article is aligned in said drive path; and second means in said magazine assembly for urging said plurality of second article towards said nose end such that said forwardmost second article is aligned in said drive path such that said uppermost surface of said second article is not below said lowermost surface of said first article.

2. The fastening tool of claim 1, wherein said first means comprises a first article pusher in said magazine secured to first spring means.

3. The fastening tool of claim 1, wherein said second means comprises a second article pusher in said magazine secured to second spring means.

4. The fastening tool of claim 1, wherein said magazine further comprises a first article rail slidably received in said magazine, said first article rail defining a track for said second article.

5. The fastening tool of claim 1, wherein said plurality of a first article are staples.

6. The fastening tool of claim 1, wherein said plurality of a second article are insulators.

7. The fastening tool of claim 1, wherein said actuating means comprises a handle pivotally mounted to said housing.

8. The fastening tool of claim 1, wherein said magazine assembly is detachably secured to said housing.

9. The fastening tool of claim 1, wherein said plurality of a first article is independent of said plurality of a second article in said magazine.

10. A fastening tool for securing an object to a substrate, said tool comprising:

a housing;

a driver mounted in said housing for reciprocal movement in a drive path;

actuating means for actuating said driver;

a magazine assembly associated with said housing, said magazine assembly containing at least one first article for securing said object to said substrate, including a forwardmost first article, said at least one first article having a lowermost surface, and containing at least one second article including a forwardmost second article, said at least one second article having an uppermost surface, said magazine assembly having a nose end and a tail end spaced from said nose end;

first means in said magazine assembly for urging said at least one first article towards said nose end such that said forwardmost first article is aligned in said drive path; and second means in said magazine assembly for independently urging said at least one second article towards said nose end such that said forwardmost second article is aligned in said drive path such that said uppermost surface of said second article is never below said lowermost surface of said first article.

11. The fastening tool of claim 10, wherein said first means comprises a first article pusher in said magazine secured to first spring means.

12. The fastening tool of claim 12, wherein said second means comprises a second article pusher in said magazine secured to second spring means.

13. The fastening tool of claim 10, wherein said magazine further comprises a first article rail slidably received in said magazine, said first article rail defining a track for said second article.

14. The fastening tool of claim 10, wherein said plurality of a first article are staples.

15. The fastening tool of claim 10, wherein said plurality of a second article are insulators.

16. The fastening tool of claim 10, wherein said actuating means comprises a handle pivotally mounted to said housing.

17. The fastening tool of claim 10, wherein said magazine assembly is detachably secured to said housing.

18. The fastening tool of claim 10, wherein said plurality of a first article is independent of said plurality of a second article in said magazine.

* * * * *